F6966 XR 3,992,250

United States Patent [19]

Chaudhuri et al.

[11] 3,992,250

[45] Nov. 16, 1976

[54] METHOD FOR BLEACHING OF HIGH CONSISTENCY CELLULOSIC PULP

[75] Inventors: Punya B. Chaudhuri, Norrkoping; Nils G. Norberg, Karlstad, both of Sweden

[73] Assignee: Kamyr A.B., Karlstad, Sweden

[22] Filed: Mar. 21, 1975

[21] Appl. No.: 560,863

[30] Foreign Application Priority Data

Mar. 21, 1974 Sweden ..... 7403806

[52] U.S. Cl. ..... 162/88; 8/108 R; 8/108 A; 162/89

[51] Int. Cl.[2] ..... D21C 9/12; D21C 9/14

[58] Field of Search ..... 162/87, 19, 88, 89; 8/108, 108 R, 108 A

[56] References Cited

UNITED STATES PATENTS

| | | | |
|---|---|---|---|
| 2,514,503 | 7/1950 | McEwen et al. | 162/87 X |
| 2,730,426 | 1/1956 | Becker | 162/88 X |
| 3,433,702 | 3/1969 | Jack et al. | 162/88 X |
| 3,455,777 | 7/1969 | Goodwald | 162/87 X |
| 3,501,374 | 3/1970 | Jack et al. | 162/89 |
| 3,536,577 | 10/1970 | Rapson | 162/89 X |
| 3,579,419 | 5/1971 | Yorston et al. | 162/88 X |

*Primary Examiner*—S. Leon Bashore
*Assistant Examiner*—Arthur L. Corbin
*Attorney, Agent, or Firm*—Cushman, Darby & Cushman

[57] ABSTRACT

A method for bleaching pulp comprising the steps of dewatering or thickening the pulp to a solids concentration of about 30–40 percent, and then treating the pulp with a first treatment liquid, in a vessel, having between 3 and 10 grams of chlorine gas dissolved therein, corresponding to a charge of 20–80 kg of chlorine per ton of pulp resulting in a solids concentration of the treated pulp of 6–15 percent. Treatment with a second liquid in the vessel and other treatment steps may also be performed.

5 Claims, 2 Drawing Figures

METHOD FOR BLEACHING OF HIGH CONSISTENCY CELLULOSIC PULP

BACKGROUND AND SUMMARY OF THE INVENTION

The present invention has reference to bleaching, especially with chlorine, of cellulose pulp obtained by delignification of vegetable fiber containing raw material such as wood, bamboo, bagasse, straw, and reeds.

Conventionally, such chlorine bleaching is performed at a pulp concentration of about 3–4 percent fibers or solids, i.e. at relatively low concentration of fibers in a watery suspension. This concentration has by experience been found most suitable, since chlorine has a very rapid initial reaction with pulp, whereby the main part of the chlorine reacts directly after the introduction. During such bleaching there is a risk that certain parts of the pulp are overchlorinated and other parts underchlorinated, but due to a relatively large water quantity an effective "mixing-in" and a relatively even bleaching result are possible. Chlorine can be added as gas or as gas dissolved in liquid, so called chlorine water.

As a process it is also known to bleach pulp with chlorine at higher concentrations, e.g. 10 percent, which generally speaking is common in treatment stages in modern bleach plants. If chlorine gas is to be mixed into pulp of 10 percent concentration, there are problems associated with proper mixing-in of the gas. If, on the other hand, the chlorine is to be added as chlorine water, the liquid quantity will be relatively large with the normal solubility of chlorine in water, and the pulp will be diluted to a concentration far below the desired 10 percent concentration.

According to the present invention it is possible by using chlorine water to bleach pulp at about 10 percent solids concentration. It has been found that the liquid quantity which is necessary in order to dilute pulp of about 30–40 percent solids concentration to about 10 percent solids concentration corresponds to the amount of liquid which contains a normal chlorine charge therein for bleaching unbleached sulphate pulp or the like. According to the present invention, pulp is dewatered by conventional dewatering apparatus, such as certain types of presses, to obtain a solids concentration of 30–40 percent. The concentrated pulp is then treated in a vessel with a first treatment liquid having between 3 and 10 grams of chlorine gas dissolved therein, corresponding to a charge of 20 to 80 kilograms of chlorine per ton of pulp, a normal chlorine charge treatment. The solids concentration of the pulp after treatment is then 6–15 percent, preferably about 10 percent.

According to another aspect of the present invention the pulp is first treated with a certain quantity of $C10_2$ dissolved in liquid, preferably with a quantity corresponding to 2–8 kgs per ton pulp calculated as active chlorine, preferably in the same treatment vessel. The treated pulp may be transported to a retention vessel and retained therein for a predetermined period of time in order to reduce the amount of residual chlorine in the pulp for further stages of treatment thereof.

DETAILED DESCRIPTION OF THE INVENTION

Figure 1:
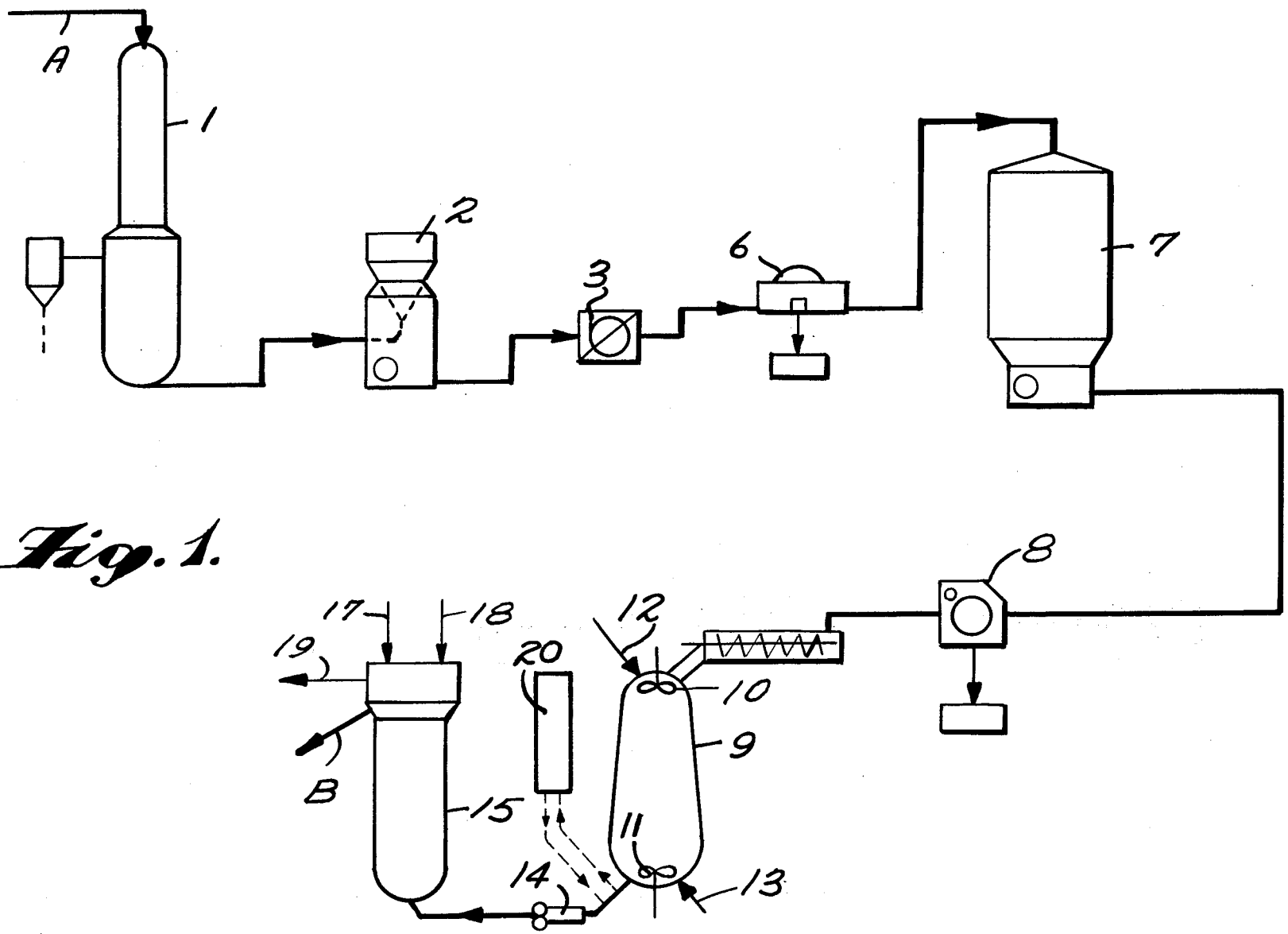
FIG. 1 is a schematic diagram of a mill pulp line assembly from the digester stage to the treatment stage according to the present invention.

In FIG. 1, A signifies fiber containing raw material which is continuously fed into the digester 1. The fiber material may be washed in the digester 1 before it is fed to a second washing stage 2, which may comprise a continuous diffuser. After washing the pulp is transported to the screening department 3 and thereafter to the thickener 6 and from there to the storage container 7. From the storage container 7 the pulp is pumped to the thickening device 8, which can be a press and which in addition to pressing even can function to wash the pulp before the pulp goes further along its path of movement on to the chlorinator 9, wherein chlorine dioxide from line 12 may be added from the top of chlorinator 9 and mixed by a device 10, while a chlorine solution from line 13 is added into the bottom part in or close to a mixing device 11. The pump 14 transports the pulp to an upflow reaction tower 15 having a top with a built-in continuous washing diffuser. Chemicals, e.g. NaOH, for the next bleaching stage may be added to the pulp through the pipe 17 and warm water may be added through the pipe 18. The dirty water from the washing or the so-called back-water from the chlorine treatment leaves at 19 and the pulp at B.

If desired, the chlorinated pulp may be transported to a retention vessel, shown diagrammatically at 20 in FIG. 1 of the drawings, for retention therein for a predetermined period of time in order to reduce the amount of residual chlorine in the pulp for further stages of treatment thereof.

After retention, the pulp may be washed, without any considerable dilution thereof.

Figure 2:
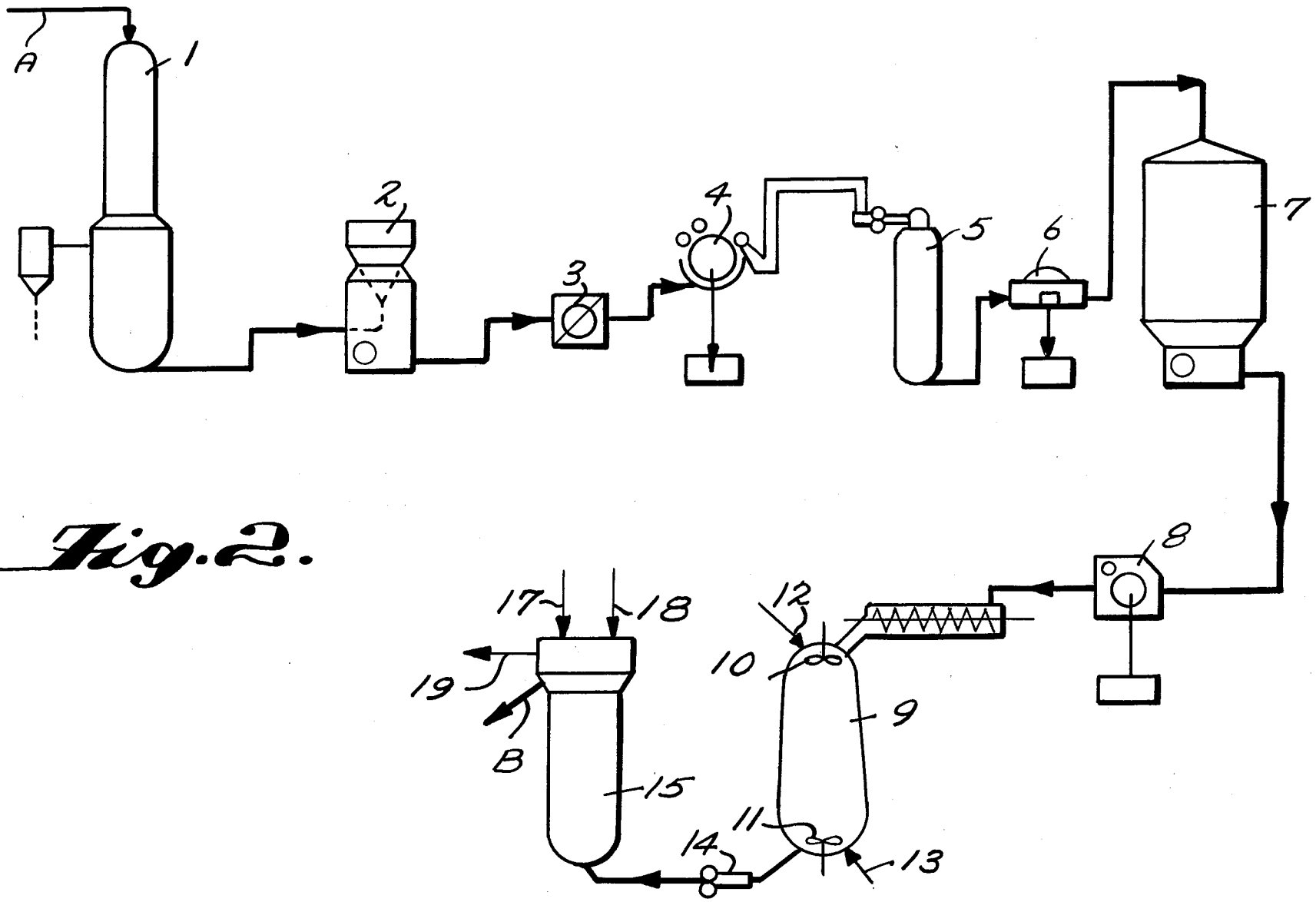
FIG. 2 is a schematic diagram of the mill pulp line assembly shown in FIG. 1 with the addition of an oxygen bleaching pretreatment stage.

The FIG. 2 assembly has reference numbers corresponding to the FIG. 1 assembly and additionally includes a thickening device 4, e.g. a press or a decker for thickening to high concentration before possible oxygen gas treatment, which takes place in a container 5.

If a sequence according to the invention is followed, the concentration of the pulp in the reaction container 15 will be about 10 percent. When conventional 3–4 percent solids concentration pulp is employed a continuous diffuser which is installed in the top of the container 15 must first thicken the pulp from the 3–4 percent concentration up to about 10 percent solids before the pulp can be washed, which necessitates extra apparatus, for example extra screen rings which considerably complicate and make the equipment more expensive. The washing itself in such a diffuser, which can be of a type disclosed in U.S. Pat. No. 3,372,087 for example, works according to the displacement principle. Compared to conventional chlorine treatment at 3–4 percent concentration the 10 percent pulp contains considerably less liquid which is to be displaced, whereby the invention has the great advantage that the displaced liquid quantity 19 will be considerably smaller. Since dirty water or back water from the chlorination stage is considered one of the major sources of pollution from such facilities, and must be treated in various manners in the factories, such treatment is considerably facilitated if the quantity of back water is considerably less, as it is according to the present invention.

If the same reaction time is provided for the pulp after the addition of the chlorine as when bleaching conventionally, it is possible with bleaching of 10 percent pulp to reduce the volume of the reaction container 15 correspondingly. Another advantage according to the present invention is that a bleach tower of smaller size may be used than at conventional chlorine bleaching facilities, which means reduced buying, installation, and maintenance costs.

The necessary chemical quantity needed for the treatment of pulp is dependent upon the type of pulp, and in order to illustrate the charges which can come into question the below figures can serve as an example. The chlorine is given in kilograms per ton of pulp and the chlorine dioxide is expressed as active chlorine in kilograms per tone of pulp.

| | $ClO_2$ | $Cl_2$ |
|---|---|---|
| Unbleached pulp, pine sulphate, Kappa number 33 | 5 | 60 |
| Semibleached pulp (e.g. oxygen bleached), pine sulphate, Kappa number 16 | 4 | 40 |
| Unbleached pulp, deciduous sulphate, Kappa number 22 | 5 | 47 |
| Semibleached pulp (e.g. oxygen bleached), deciduous sulphate, Kappa number 10 | 3 | 30 |

In all the above exemplified cases it is possible by using different degrees of solubility of chlorine in water to obtain a total solution quantity which is to be added to the pulp of about 8000 liters per ton of pulp. If starting with 40 percent as a suitable concentration of the pulp before the treatment the final concentration will be as follows: 40 percent pulp contains 1.5 tons of water per tone of pulp and with an addition of 8000 liters, or in other words about 8 tons, the total liquid quantity in the pulp will be $1.5 + 8.0 = 9.5$ tons per ton of pulp, which corresponds to a pulp solids concentration of about 9.5 percent. If for certain reasons it is desirable to use smaller solution quantities, it may be necessary to use special methods to obtain the solution of the same chlorine quantities in the liquid, e.g. by using other pressure-temperature conditions respectively.

Thickening of pulp to 30–40 percent can be effected by dewatering it in apparatus designed for such a purpose such as a screw press or drum press, vacuum apparatus, centrifugal apparatus or similar apparatus, with or without simultaneous treatment means such as washing means. Washing may be done in a "wash press."

For effecting mixing of suitable chemical solutions into the pulp in the container 9, a mixer of known type can be used, whereby the solution can be pumped into the pulp close to a rotating mixing body equipped with wings, pins or similar structures, or the solution can also be more or less added into the pulp itself through one or more outlets moving in the pulp, whereby possibly the very best distribution in the relatively thick pulp will be obtained. The last mentioned moveable outlet may be supported by added stirring devices or other mixing devices. The container 9 should suitably be filled with pulp suspension.

The invention has been herein described in what is presently conceived to be the most practical and preferred embodiment, however, many variations may be made thereof within the scope of the invention, which scope is not to be limited except by the appended claims.

What is claimed is:

1. A method of continuously treating vegetable fiber containing raw material comprising the steps of digesting said raw material to form pulp, washing said pulp, thickening said pulp so that it has a solids concentration of approximately 30–40 percent, bleaching said pulp in a first bleaching stage by treating said pulp with a first treatment liquid in a vessel, said liquid having between 3 and 10 grams of chlorine gas dissolved therein, corresponding to a charge of 20 to 80 kilograms of chlorine per ton of pulp, removing said pulp from said vessel, said pulp after said bleaching first stage upon removal from said vessel having a concentration of about 6–15% solids as a result of dilution during said first bleaching stage, and then transporting said pulp to another bleaching stage.

2. A method as recited in claim 1 comprising the further steps of transporting said treated pulp to a retention vessel, and retaining said treated pulp in said retention vessel for a predetermined period of time prior to transporting said pulp to another bleaching stage.

3. A method as recited in claim 2 comprising the further step of washing said pulp after retention thereof without any considerable dilution thereof.

4. A method as recited in claim 1 wherein said first treated pulp, upon removal from said vessel, has a solids concentration of about 10 percent.

5. A method as recited in claim 1 comprising the further step of prior to treatment of said pulp with said first treatment liquid, treating said pulp in said vessel with another treatment liquid, said other treatment liquid having dissolved therein a quantity of $ClO_2$ corresponding to 2–8 kilograms per ton of pulp calculated as active chlorine.

* * * * *